United States Patent [19]

Kawabata et al.

[11] Patent Number: 4,621,490

[45] Date of Patent: Nov. 11, 1986

[54] METHOD AND APPARATUS FOR PRODUCING A FASCIATED YARN

[75] Inventors: Susumu Kawabata, Aichi; Hiroshi Niimi, Nagoya; Meiji Anahara, Kariya; Hiroshi Omori, Aichi, all of Japan

[73] Assignees: Kabushiki Kaisha Toyoda Jidoshokki Seisakusho; Kabushiki Kaisha Toyota Chuo Kenkyusho, both of Aichi, Japan

[21] Appl. No.: 513,845

[22] Filed: Jul. 14, 1983

[30] Foreign Application Priority Data

Jul. 21, 1982 [JP] Japan ..... 57-125852

[51] Int. Cl.[4] ..... D01H 5/28; D01H 5/18; D02G 1/04; D02G 1/16

[52] U.S. Cl. ..... 57/328; 57/333; 57/350

[58] Field of Search ..... 57/328, 333, 350, 293

[56] References Cited

U.S. PATENT DOCUMENTS 4,124,972 11/1978 Arai et al. ..... 57/333 X
4,434,611 3/1984 Hasegawa et al. ..... 57/333 X
4,489,545 12/1984 Susumu et al. ..... 57/328 X

FOREIGN PATENT DOCUMENTS 63439 5/1977 Japan ..... 57/333

*Primary Examiner*—John Petrakes
*Attorney, Agent, or Firm*—Burgess, Ryan & Wayne

[57] ABSTRACT

A method and an apparatus for producing a fasciated yarn, utilizing an air nozzle for false-twisting a fiber bundle. The apparatus is provided with a fiber passage comprising an inlet portion, a small channel, and a large channel, and is provided also with a contact area on an inner wall of the small channel, this contact area being formed by the intersection at an angle of the small channel and the large channel.

During the spinning operation, the fiber bundle is forced against the contact area, effectively suppressing a twist imparted by a vortex such that it does not ascend toward the upstream region.

Also, since ballooning can be suppressed by the contact area, the size of the small channel can be increased, resulting in the intake by suction of a sufficient amount of air in the inlet portion.

9 Claims, 6 Drawing Figures

METHOD AND APPARATUS FOR PRODUCING A FASCIATED YARN

BACKGROUND OF THE INVENTION

1. Field of the Invention

The present invention relates to a method and an apparatus for producing a fasciated yarn.

2. Description of the Prior Art

In fasciated yarn spinning, a fiber bundle delivered from a pair of front rollers of a draft means is introduced into an air nozzle and therein is false-twisted by a vortex. During untwisting of the false-twisted fiber bundle, part of the fibers in the fiber bundle entangle around a core portion thereof to form a fasciated yarn. Generally speaking, to obtain a good quality yarn, the fiber bundle has to fed in the shape of a ribbon having a sufficient number of free-end fibers prior to bieng twisted. A free-end fiber is a fiber, one end of which is embedded in the body of the bundle and the other end of which is free. Through the application of a vortex, some of the free-end fibers are converted to wrap fibers which entangle around the resultant yarn.

In order to generate a sufficient number of free-end fibers, twisting of the fiber bundle in the nozzle inlet must be suppressed as much as possible to retain the ribbon shape of the bundle. Accordingly, a typical conventional air nozzle has a small channel in the fiber passage between the inlet portion and a large channel in which a vortex is generated. The false twist of the fiber bundle can be prevented to a certain extent from ascending to the inlet portion by the small channel.

Naturally, the twist-suppressing effect increases as the cross-sectional size of the small channel becomes smaller. However, an excessively narrow small channel causes insufficient suction of the air nozzle, which results in various problems, such as the generation of many flies, fiber wrapping on the roller surface, and the generation of less free-end fibers.

Conversely, simple enlargement of the cross-sectional size of the small channel results in a decrease in the twist-suppressing effect. This drawback is augmented by the generation of ballooning, which disrupts the stable spinning operation and deteriorates the quality of the resultant yarn.

When ballooning occurs in the air nozzle, the false twist imparted to the fiber bundle easily escapes upstream toward the front rollers; the final twist remaining in the downstream region of the fiber bundle is insufficient by itself for forming a strong yarn.

In one attempt to eliminate such drawbacks is disclosed in Japanese Unexamined Patent Publication (Kokai) No. 52-63439, which describes an air nozzle having a bent large channel. In this air nozzle, rotation of the fiber bundle caused by its eccentricity within the large channel is slowed by contact with the inner wall of the large channel. As a result, insufficient twist is imparted to the fiber bundle, giving a yarn with a looser structure than conventional yarn.

SUMMARY OF THE INVENTION

One object of the present invention is to provide an apparatus for producing a fasciated yarn, the air nozzle of which has good fiber sucking, twist-suppressing, and balloon-suppressing properties.

Another object of the present invention is to provide a method for obtaining a fasciated yarn of good quality by blocking the twist ascent and by restraining ballooning in the air nozzle.

These objects are attainable by an apparatus for producing a fasciated yarn having an air nozzle that imparts a false twist to the fiber bundle to be treated, the nozzle comprising a fiber passage in which an inlet portion, a small channel, and a large channel are successively arranged in the downstream direction along the traveling route of the fiber bundle, the large channel being provided with at least one jet pointing tangentially along the fiber passage, the apparatus being such that the axis of the small channel intersects with the axis of the large channel to form at least a contact area in the small channel.

The present invention also provides a method for producing a fasciated yarn in which a fiber bundle delivered in a ribbon shape from a draft means is introduced into a fiber passage of an air nozzle, the passage comprising an inlet portion, a small channel, and a large channel, and therein is false twisted by a vortex to form the fasciated yarn; this method includes forcibly pressing the fiber bundle against at least one contact area so provided in the small channel that the traveling route of the fiber bundle bends at the contact area.

The abovesaid method and apparatus have an advantage of maintenance of stable spinning operation by suppressing generation of a yarn ballooning in the fiber passage. The yarn ballooning is suppressed by the contact of the fiber bundle with the contact area, and if it occurs, is prevented from ascending toward the front rollers of the draft means. The suppression of the yarn ballooning produces the excellent resultant yarn having good strength and evenness because the false twist does not ascend toward the front rollers and thereby a sufficient twist difference can be maintained betwen the upstream and downstream regions of the fiber bundle and the fiber bundle in the inlet portion keeps its ribbon shape, causing the sufficient free end fibers which can tightly entangle around the core portion of the resulted yarn.

Further, according to the present invention, since a diameter of the small channel may be enlarged without considering twist ascent, the suction of the air nozzle can be improved, thereby decreasing the amount of flies.

BRIEF DESCRIPTION OF THE DRAWINGS

The present invention is described more specifically below with reference to the attached drawings, in which.

DESCRIPTION OF THE PREFERRED EMBODIMENTS

Figure 1:
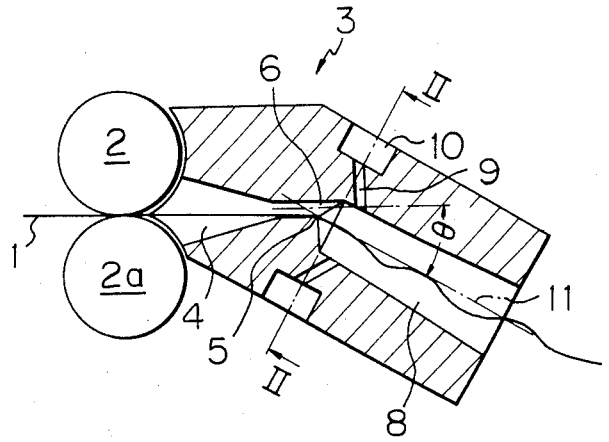
FIG. 1 is a sectional side view of a first embodiment according to the present invention.

In FIG. 1, downstream from a draft means comprising several pairs of rollers and/or aprons utilized for attenuating a fiber bundle 1, there is provided an air nozzle 3 confronting a pair of front rollers 2, 2*a*. The air nozzle 3 comprises a fiber passage which consists of an inlet portion 4, a small channel 6, and a large channel 8, all of which are arranged along the traveling route of the fiber bundle. A plurality of jets 9 are provided in the middle of the air nozzle 3. One end of each of the jets 9 communicates with a reservoir 10 recessed in the outer wall of the air nozzle 3. The other end of each of the jets 9 opens on the inner wall of the large channel 8 in the vicinity of the upstream end thereof. The jets 9 incline downstream so as to enhance the traveling of the fiber bundle and are oriented tangentially to the axis of the fiber passage such as to generate a vortex. The reservoir 10, in turn, is connected to a pressurized air source (not shown).

Figure 2:
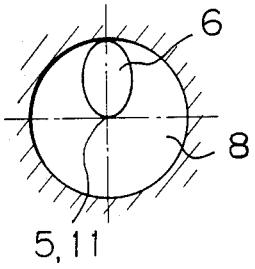
FIG. 2 is a sectional end view of a small and a large channels along II—II plane in FIG. 1.

In the first embodiment shown in FIG. 1, the fiber passage bends at the point where the small channel 6 and the large channel 8 meet in such a manner that the outside face of the inner walls of both channels 6 and 8 are connected in a smoothly continuous manner but the inside faces thereof are connected in a stepped, non-continuous manner. In other words, the axis of the large channel 8 meets a downstream end 5 of the inside face of the inner wall of small channel 6. This structure is more clearly illustrated in FIG. 2, in which a cross section of the small channel 6 in a plane II—II of FIG. 1 perpendicular to the axis 11 of the large channel 8 appears as an ellipse with its major axis defined by the center of the circular cross section of the large channel 8 and the point lying on the circumference thereof. In FIG. 2, the center of the circle lies on the axis 11 of the large channel 8 and the downstream end 5 of the inside surface of the small channel 6.

The fiber bundle 1 attenuated by the draft means is delivered from the nip point of the front rollers 2, 2*a* as a fiber ribbon to the inlet portion 4 of the air nozzle 3. The fiber bundle 1 travels along the axis of the inlet portion 4, the cross section of which gradually decreases in the traveling direction of the fiber bundle 1, and reaches the upstream end of the small channel 6. In the small channel 6, the fiber bundle 1 travels along a line between the nip point of the front rollers 2, 2*a* and the downstream end 5 of the small channel 6, at which point the fiber bundle 1 is forcibly brought into contact with the bottom face of the inner wall; that is, the downstream end 5 constitutes a contact area in the fiber passage (hereinafter the contact area is also indicated by reference numeral 5).

Air is introduced into the jets 9 opening in the upstream portion of the large channel 8. The air forms a spiral vortex around the axis of the large channel 8 and twists the fiber bundle 1 delivered from the small channel 6. The vortex created in the large channel 8 is gradually exhausted and loses its spinning torque, resulting in untwisting of the fiber bundle 1 which was twisted in the upstream portion of the large channel. During the untwisting operation, the free-end fibers become entangled around the core portion of the fiber bundle at a spiral angle in the reverse direction as the vortex, giving a fasciated yarn.

As stated above, the twist of the fiber bundle in the inlet portion 4 and the small channel 6 is preferably as low as possible while that in the large channel 8 is preferably as high as possible for obtaining a good fasciated yarn since the difference in twist between the upstream and downstream regions of the treated fiber bundle determines the number and spiral angle of the wrap fibers and, in turn, the structure of the fasciated yarn. The above-mentioned desirable twist distribution in the fiber bundle 1 depends mainly on the construction of the contact area 5. The bending angle of the fiber passage at the point where the small channel 6 and the large channel 8 meet has an especially great influence on the ascent of the twist in the upstream direction. In a study conducted by the present inventors, it was found that the fiber passage is preferably constructed in such a manner that the axes of the small channel 6 and the large channel 8 intersect at an angle $\theta$ ranging from 10° to 90°, and preferably in a range of from 20° to 70°.

The fiber bundle 1 introduced into the large channel 8 travels along the axis 11 thereof due to the holding action of the contact area 5 at the upstream end of the axis 11. The fiber bundle 1 travels along a path centering on the axis 11, thereby enhancing the twist efficiency of the vortex for the fiber bundle, but a slight deviation from this axis is allowable.

Another advantage of the invention is that the cross-sectional size of the small channel can be made larger than in conventional apparatus of this type since the traveling route of the fiber bundle can be fixed throughout the fiber passage, especially along the center axis of the large channel 8, enabling the proper control of yarn ballooning. This small channel 6 having an increased cross-sectional size enhances the amount of air sucked thereinto from the open end of the inlet portion 4, thereby decreasing the amount of flies in the vicinity of the front rollers 2, 2*a*.

Figure 3:
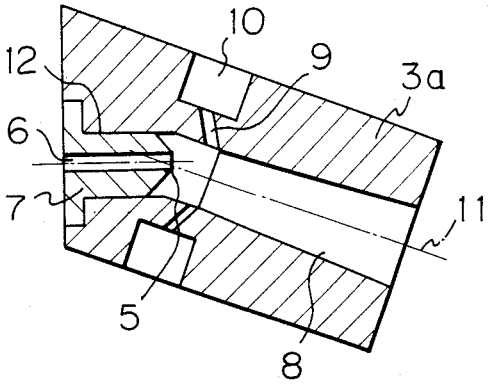
FIG. 3 is a sectional side view of part of a second embodiment according to the present invention.

A second embodiment according to the present invention is described with reference to FIG. 3. One main difference between the two embodiments is that, in the second, the small channel 6 projects into the large channel 8, thereby protecting the orientation of the free end fibers in the fiber bundle running through the small channel from being disturbed, and thus causing a desirable wrapping effect around the core portion in the resulting yarn.

This type of air nozzle is difficult to manufacture due to its complicated shape. Therefore, it is preferable that an insert 7 through which the small channel 6 is provided be prepared separately from a nozzle body 3*a* having a recess 12 and the large channel 8 of the same diameter as the recess 12, the axes of which both intersect in the vicinity of the border therebetween. The insert 7 is fitted into the recess 12 to complete the successive channels 6 and 8. The inlet portion 4, omitted in FIG. 3 for simplicity, is attached in front of the small channel 6, which is also separately prepared. The insert 7 may also be manufactured in one piece that includes the inlet portion 4.

Figure 4:
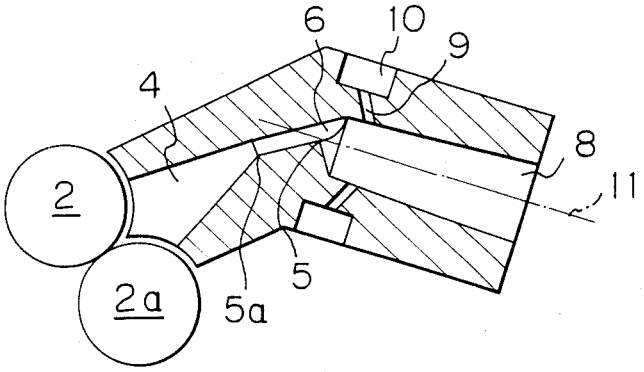
FIG. 4 is a sectional side view of a third embodiment according to the present invention.

In FIG. 4, a third embodiment of the present invention is illustrated. In this embodiment, bent portions of the fiber passage are provided not only between the large channel 8 and the small channel 6, but also between the small channel 6 and the inlet portion 4. The small channel 6 is thereby provided with another contact area 5*a* at the downstream end of the inlet portion 4 in addition to a contact area 5 like that provided in the preceding embodiments. Due to the additional contact area 5*a*, twist ascent toward the nip point of the rollers 2 and 2*a* can be prevented more effectively. The same directional curvature of the three portions 4, 6, and 8 are preferable for enhancement of the stable contact of the fiber bundle with the inside surface of the small channel 6.

Figure 5:
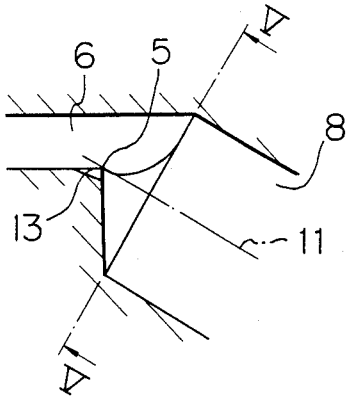
FIG. 5 is an enlarged sectional side view of a small and a large channel of a fourth embodiment showing the area of connection between the two channels.
Figure 6:
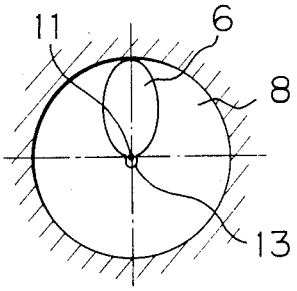
FIG. 6 is a sectional end view of a small and a large channel along V—V plane in FIG. 5.

In FIGS. 5 and 6, a fourth embodiment of the present invention is illustrated. This is a modification of the first embodiment shown in FIGS. 1 and 2. The embodiment has a contact area 5 at the downstream end of the inner wall of the small channel 6. The contact area 5 is constituted in the same manner as in the first embodiment does, except that a groove 13 is provided on the inner wall at the contact area. The groove 13 laterally limits the traveling route of the fiber bundle, thereby improving the processing stability, increasing the twist efficiency, and enhancing the twist-suppressing effects. In this embodiment, as shown in FIG. 6, a slight deviation of the bottom of the groove 13 from the axis of the large channel 8 is harmless for the abovesaid function of the groove 13.

Grooves may be applied to each of the contact areas if a plurality of the contact areas are formed in the fiber passage, as in the third embodiment. These grooves may furthermore be provided throughout the length of the small channel 6 on the inner wall thereof on which the contact area or areas are provided.

According to the present invention, the generation of ballooning in the fiber passage can be suppressed by making the fiber bundle contact the contact area. Furthermore, if ballooning occurs in the fiber passage, it can be easily suppressed before being transmitted to the vicinity of the front rollers by the action of the contact area, thereby enabling, unstable spinning to be avoided. Due to the twist-suppressing effect of the contact area, a sufficient twist difference can be maintained between the upstream and downstream regions of the fiber bundle, thereby making it possible to obtain a tightly entangled fasciated yarn.

Moreover, due to the abovesaid twist-suppressing effect, a plurality of free-end fibers is generated in the upsteam region of the fiber bundle, thereby yielding a good fasciated yarn of uniform quality and without fluffs.

Moreover, according to the present invention, since the size of the small channel can be increased without considering twist ascent, the suction of the air nozzle can be improved, thereby decreasing the amount of flies.

We claim:

1. An apparatus for producing a fasciated yarn having an air nozzle for imparting a false twist to a fiber bundle to be treated, said nozzle comprising a fiber passage in which an inlet portion, a small channel, and a large channel are successively arranged in the downstream direction along a traveling route of said fiber bundle, said large channel being provided with at least one jet pointing tangentially along said fiber passage, said apparatus being characterized in that the axis of said large channel is straight throughout the entire length of said large channel, the axis of said small channel intersects with the axis of said large channel at an angle $\theta$ to form at least one contact area in said small channel for ensuring continuous contact between the fiber bundle and said small channel, and said contact area is provided on an inner wall of said small channel at a portion near the longitudinal axis of said large channel.

2. An apparatus according to claim 1, wherein said contact area is provided on said inner wall of said small channel at a point where said small channel and said large channel meet.

3. An apparatus according to claim 1, wherein said contact area is provided on said inner wall of said small channel and extends over the entire length of said small channel.

4. An apparatus according to one of claims 1 through 3, wherein said contact area has a groove on the bottom thereof.

5. An apparatus according to claim 1, wherein said angle $\theta$ lies within a range of from 10 degrees to 90 degrees.

6. An apparatus according to claim 5, wherein said angle $\theta$ lies within a range of from 20 degrees to 70 degrees.

7. A method for producing a fasciated yarn in which a fiber bundle delivered in a ribbon shape from a draft means is introduced into a fiber passage of an air nozzle, said passage comprising an inlet portion, a small channel, and a large channel, the small channel having a longitudinal axis which intersects at an angle $\theta$ with the longitudinal axis of the large channel, the axis of the large channel being straight throughout its length, wherein the fiber bundle is false-twisted by a vortex to form said fasciated yarn, said method being characterized by the steps of passing the fiber bundle through the small channel, forcibly pressing the fiber bundle from the small channel against at least one contact area provided on an inner wall of the small channel near the longitudinal axis of the large channel to ensure continuous contact between the fiber bundle and the small channel, and passing the fiber bundle which has been forcibly pressed against said at least one contact point through said large channel.

8. A method according to claim 7, wherein said angle $\theta$ lies within a range of from 10 degrees to 90 degrees.

9. A method according to claim 8, wherein said angle $\theta$ lies within a range of from 20 degrees to 70 degrees.

* * * * *